US007133824B2

(12) United States Patent
Wu et al.

(10) Patent No.: US 7,133,824 B2
(45) Date of Patent: Nov. 7, 2006

(54) NOISE REDUCTION METHOD

(75) Inventors: Kuo-Guan Wu, Miaoli (TW); Po-Cheung Chen, Sanchung (TW)

(73) Assignee: Industrial Technology Research Institute, Hsinchu (TW)

( * ) Notice: Subject to any disclaimer, the term of this patent is extended or adjusted under 35 U.S.C. 154(b) by 840 days.

(21) Appl. No.: 10/067,274

(22) Filed: Feb. 7, 2002

(65) Prior Publication Data

US 2003/0078772 A1 Apr. 24, 2003

(30) Foreign Application Priority Data

Sep. 28, 2001 (TW) ..... 90124022 A

(51) Int. Cl.
*G10L 21/02* (2006.01)

(52) U.S. Cl. ..... 704/226

(58) Field of Classification Search ..... 704/226–228, 704/233
See application file for complete search history.

(56) References Cited

U.S. PATENT DOCUMENTS 6,678,657 B1 * 1/2004 Bruckner et al. ..... 704/240

OTHER PUBLICATIONS

M. Berouti, R. Schwartz, and J. Makhoul, "Enhancement of Speech Corrupted by Acoustic Noise", 1979, pp. 208-211.
Kuo-Guan Wu and Po-Cheng Chen, "Efficient Speech Enhancement Using Spectral Subtraction for Car Hands-free Applications", Jun. 19-21, 2001, pp. 220-221.
Elias Nemer, Rafik Goubran, And Samy Mahmoud, "SNR Estimation of Speech Signals Using Subbands and Fourth-Order Statistics", Jul. 1999 IEEE, pp. 171-174.

* cited by examiner

*Primary Examiner*—Angela Armstrong
(74) *Attorney, Agent, or Firm*—Bacon & Thomas, PLLC

(57) ABSTRACT

A noise reduction method partitions frequency band into multiple sub-bands and estimates the signal-to-noise ratio (SNR) value for each sub-band. An over-subtraction factor of each sub-band is determined based on the estimated SNR value. Then, the clean speech spectrum estimate is determined by performing spectral over-subtraction on each sub-band, so as to determine the clean speech signal from the estimated clean speech spectrum.

5 Claims, 2 Drawing Sheets

NOISE REDUCTION METHOD

BACKGROUND OF THE INVENTION

1. Field of the Invention

The present invention relates to a noise reduction method and, more particularly, to a method using spectral subtraction to reduce noise.

2. Description of Related Art

The spectral subtraction method has been proven effective in enhancing speech degraded by additive noise. It is simple to implement, hence is suitable as the pre-processing scheme for speech coding and recognition applications. This method subtracts the noise spectrum estimate from the noisy speech spectrum to estimate the speech magnitude spectrum, so as to obtain the clean speech signals.

FIG. 1 shows the flowchart of the aforementioned spectral subtraction method, wherein the input noisy speech is divided into a plurality of continuous frames, and each frame is represented by an additive noise model:

$$y_r(k)=s_r(k)+w_r(k),$$

where $y_r(k)$, $s_r(k)$ and $w_r(k)$ denote respectively the k-th noisy speech, clean speech, and noise sample of the r-th frame. Taking the fast Fourier transform of the noisy speech frame $y_r(k)$ (step S101), the noisy speech spectrum of the r-th frame at the k-th frequency component is obtained and denoted as $|Y_r(k)|^2$. In addition, the noisy speech $y_r(k)$ is also applied in a silence detection process (step S102) and a noise spectrum estimation process (step S103) to estimate a noise spectrum, denoted as $|W_r(k)|^2$. After performing a spectral subtraction process (step S104), the energy spectrum of clean speech is obtained as follows:

$$|\hat{S}_r(k)|^2=|Y_r(k)|^2-|W_r(k)|^2. \quad (1)$$

If the phase spectrum of the clean speech can be approximated by the phase spectrum of the noisy speech, the estimate of clean speech $\hat{s}_r(k)$ can be obtained by taking the inverse fast Fourier transform of $|\hat{S}_r(k)|^2$.

Such a method is suitable as the pre-processing scheme for speech coding and recognition applications because it is easy, effective and simple to implement. However, the noise spectrum estimate may cause a relatively large spectral excursion in the spectrum estimate of clean speech. This spectral excursion will be perceived as time varying tones contributing to the so-called musical noise.

To reduce the musical noise Berouti et al proposed a noise reduction method to over-subtract the noise spectrum estimate, and a description of such can be found in M. Berouti, R. Schwartz, and J. Makhoul "Enhancement of speech corrupted by acoustic noise", pp. 208–211, 1979 IEEE, which is incorporated herein for reference, wherein the formula (1) is modified as:

$$|\hat{S}_r(k)|^2=|Y_r(k)|^2-\alpha_r\cdot|W_r(k)|^2.\ \alpha_r\geqq 1, \quad (2)$$

so as to decrease the influence caused by the excursion of the noise spectrum estimate and thus reduce the effect of musical noise. In the method, the over-subtraction factor $\alpha_r$ was determined by the signal-to-noise ratio (SNR) of the processing frame, and can be expressed by formula:

$$\alpha_r = \alpha_0 + SNR_r \cdot \frac{1-\alpha_0}{SNR_1}, \quad (3)$$

where $\alpha_0$ is pre-selected over-subtraction factor when SNR=0, $SNR_1$ is pre-selected SNR value when $\alpha_r=1$, $SNR_r$ is the estimate of signal-to-noise ratio of the processed r-th frame. Based on the formula (3), it is known that $\alpha_r$ is inversely proportional to $SNR_r$. The smaller the $SNR_r$ is, the larger the $\alpha_r$ is, and a larger $\alpha_r$ is helpful in removing the larger noise spectrum excursion.

Examining human speech spectrum, it is known that the speech energy distributes non-uniformly and often concentrates on lower frequency components. Hence SNR differs with frequencies and often have larger values at lower frequency components. From the formula (3), it is known that more suppression is needed for lower SNR and vise versa. High-frequency components thus need more suppression to avoid musical noise, while low-frequency components need less suppression to prevent speech distortion. However, for the over-subtraction method based on formulas (2) and (3), it faces the problem of too much over-subtraction and hence speech distortion at low-frequency components while too less over-subtraction and hence musical noise at high-frequency components. Accordingly, improved schemes are proposed to avoid such a problem, and one of the schemes can be found in Kuo-Guan Wu and Po-Cheng Chen "Efficient speech enhancement using spectral subtraction for car hands-free application". 2001 Digest of technical papers, pp. 220–221, which is incorporated herein for reference. However, it is unable to completely eliminate the problem. Therefore, there is a need for the above conventional noise reduction method to be improved.

SUMMARY OF THE INVENTION

The object of the present invention is to provide a noise reduction method capable of effectively eliminating the musical noise and reducing speech distortion.

To achieve the object, the noise reduction method divides input noise speech into a plurality of continuous frames, determines noisy speech spectrum for each frame, and partitions frequency band into multiple sub-bands to determine clean speech spectrum from the noisy speech spectrum on each sub-band. The method is provided to first estimate noise spectrum of r-th frame at k-th frequency component from the noisy speech of r-th frame by silence detection and noise spectrum estimation. Next, the signal-to-noise ratio (SNR) value of i-th sub-band for r-th frame is estimated. Then, an over-subtraction factor of sub-band i is determined based on the estimated sub-band SNR. Finally, the clean speech spectrum estimate is determined by performing a spectral subtraction on each sub-band.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
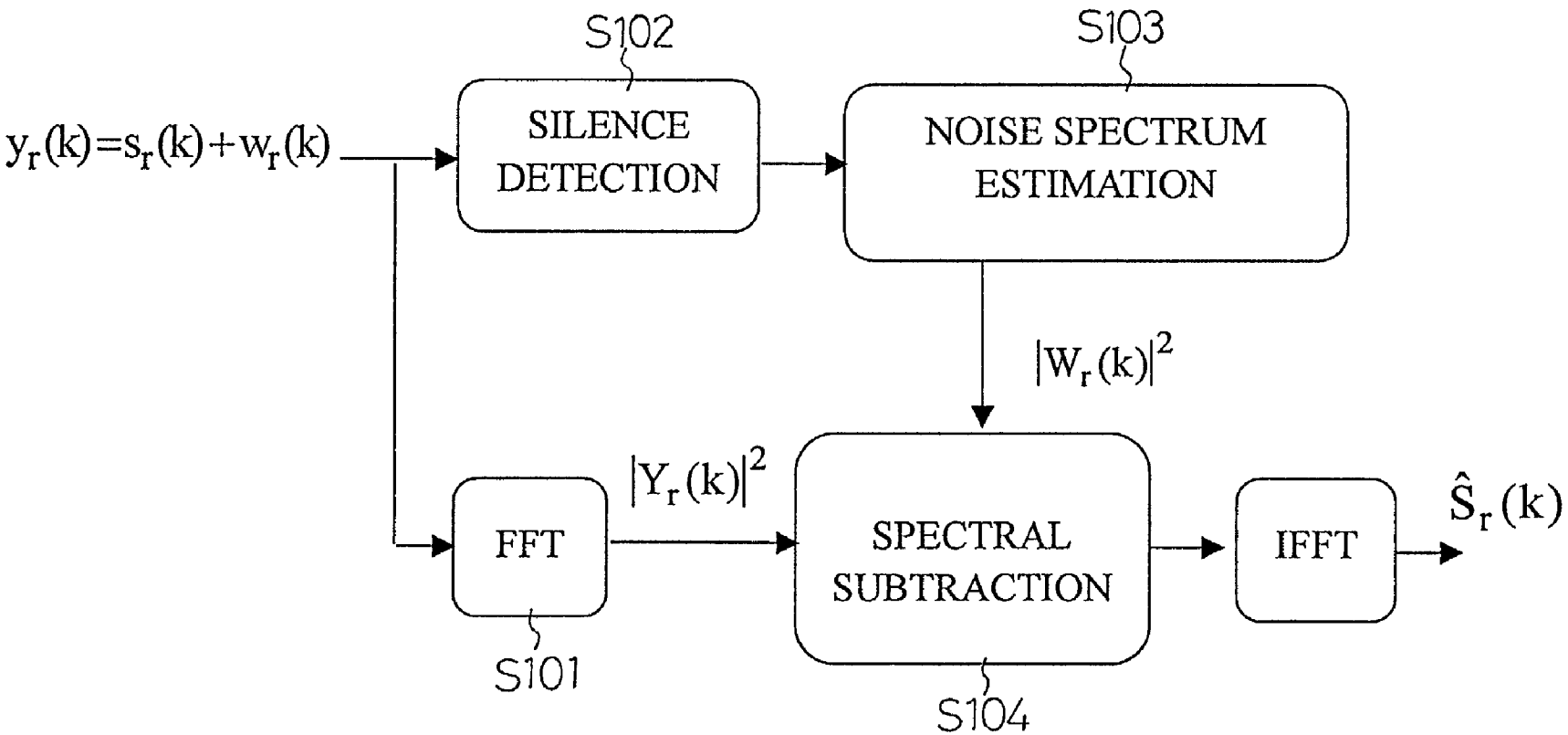
FIG. 1 PRIOR ART
FIG. 1 is the flowchart of a conventional spectral subtraction method.
Figure 2:
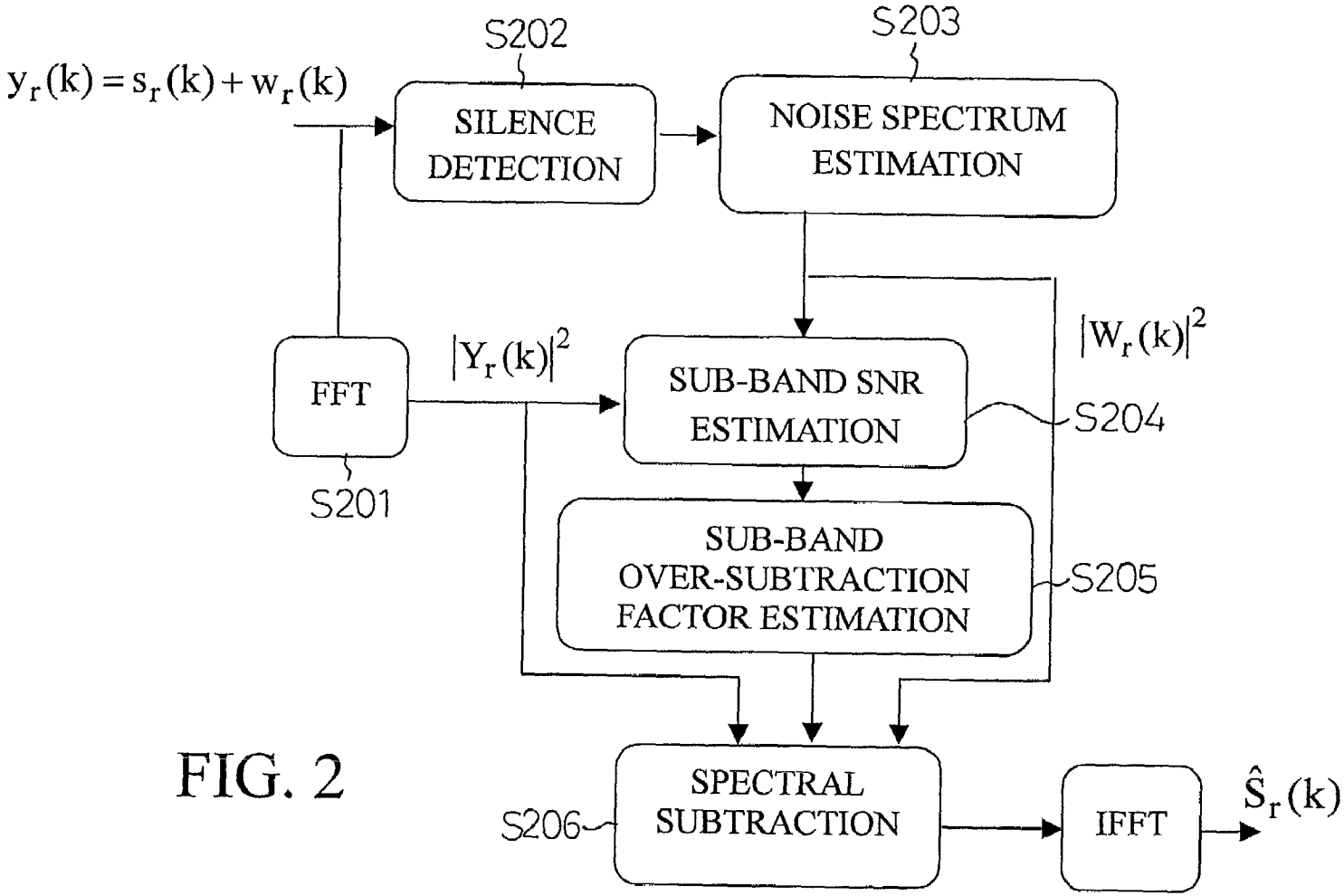
FIG. 2 is the flowchart of the noise reduction method in accordance with the present invention.

With reference to FIG. 2, there is shown the flowchart of a preferred embodiment of the noise reduction method in accordance with the present invention. As shown, the input noisy speech of the r-th frame $y_r(k)=s_r(k)+w_r(k)$ is processes by FFT (fast Fourier Transform) (step S201) to obtain its energy spectrum $|Y_r(k)|^2$. The noisy speech $y_r(k)$ is also processed by silence detection (step S202) and noise spectrum estimation (step S203) to estimate the noise spectrum of the r-th frame, denoted as $|W_r(k)|^2$.

For the noisy speech spectrum $|Y_r(i,k)|^2$ and noise spectrum $|W_r(i,k)|^2$, the method of the present invention utilizes a sub-band over-subtraction mechanism to determine the estimate of clean speech spectrum $|\hat{S}_r(i,k)|^2$, which is then processed by IFFT (Inverse Fast Fourier Transform) (Step S207) for being restored to enhanced frame signal $\hat{s}_r(k)$. The method of the present invention partitions the frequency band into multiple sub-bands and performs over-subtraction on each sub-band to implement over-subtraction on each sub-band, it is first performed a sub-band SNR estimation (step S204) to estimate an SNR value for determining the over-subtraction factor of the sub-band. The SNR value can be obtained by a regression formula as follows:

$$SNR_r(i) = \mu \cdot SNR_{r-1}^{o}(i) + (1-\mu) \cdot 10 \cdot \log_{10}\left(\frac{\sum_{k \in sub-band\ i} |Y_r(i,k)|^2}{\sum_{k \in sub-band\ i} |W_r(i,k)|^2} - 1\right)$$

where I is the index of the sub-band, $SNR_r(I)$ is the SNR estimate of the i-th sub-band for the r-th frame, $|Y_r(i,k)|^2$ is the noisy speech spectrum of the r-th frame at the k-th frequency component of the i-th sub-band, $|W_r(i,k)|^2$ is the corresponding noise spectrum, $\mu$ is a predetermined weight in a range of $0<\mu<1$, and $SNR_{r-1}^{o}(i)$ is the SNR of the sub-band for the previous frame after noise reduction, which is expressed by the following formula:

$$SNR_{r-1}^{o}(i) = 10 \cdot \log_{10} \frac{\sum_{k \in sub-band\ i} |\hat{S}_r(i,k)|^2}{\sum_{k \in sub-band\ i} |W_r(i,k)|^2},$$

where $|\hat{S}_r(i,k)|^2$ is the estimate of the clean speech spectrum of the previous, i.e., the (r−1)-th, frame after being processed in the sub-band i.

In step S205, the sub-band over-subtraction factor $\alpha_r(i)$ is determined based on the estimated sub-band SNR value $SNR_r(i)$, and is expressed by the formula as follows:

$$\alpha_r(i) = \alpha_0(i) + SNR_i(i) \cdot \frac{1-\alpha_0(i)}{SNR_1(i)},$$

where $\alpha_0(i)$ is pre-selected over-subtraction factor when the actual $SNR_r(i)=0$ at sub-band i, and $SNR_1(i)$ represents pre-selected SNR value when $\alpha_r(i)=1$.

Once determining the over-subtraction factor $\alpha_r(i)$ for each sub-band i, it is able to perform spectral over-subtraction on each sub-band i (step S206), as expressed by the following formula:

$$|\hat{S}_r(i,k)|^2 = |Y_r(i,k)|^2 - \alpha_r(i) \cdot |W_r(i,k)|^2,$$

wherein the determined $|\hat{S}_r(i,k)|^2$ is the clean speech spectrum at sub-band i for the r-th frame. After performing over-subtraction for each sub-band i, the IFFT is applied (step S207) to obtain the estimated enhanced frame signal $\hat{s}_r(k)$.

In executing the aforementioned method, due to the small number of frequency samples in the lower bands, there will be large variation in sub-band SNR estimate when the noise is strong, which may cause an error in $\alpha_r(i)$ and influence the quality of the restored speech. To avoid such a problem, in step S205, the SNR value $SNR_r$ of the whole frame is incorporated into modification of sub-band over-subtraction factors as follows:

$$\alpha_r(i)=\alpha_{max} \text{ if } SNR_r<SNR_{min},$$

where $SNR_{min}$ is pre-selected minimum value of SNR.

Furthermore, in this embodiment, the step S204 employs regression scheme to estimate the SNR value for determining the over-subtraction factor of the sub-band. However, in practical application, the SNR value of sub-band can also be determined by other known speech signal SNR estimation methods, for example, the high order statistic method described in Elias Nemer, Rafik Goubran and Samy Mahmoud: 'SNR estimation of speech signals using subbands and fourth-order statistics', IEEE Signal Processing Letters, 1999, vol. 6, no. 7, pp. 171–174, which is incorporated herein for reference.

To verify the effect of the present noise reduction method, noisy speech data is generated by adding clean speech data with white Gaussian noise of variant magnitudes to form 3 segmental SNRs: 15 dB, 10 dB and 5 dB. Eight clean speech sentences are collected with 5 sentences from males and 3 from females. Table 1 compares the averaged segmental SNR improvements of conventional over-subtraction method (with parameters of $\alpha_0=7.5$ and $SNR_1=20$) and those of the present method (with parameters of $\alpha_0(1\sim18)=2$, $SNR_1(1\sim13)=1.5$, $SNR_1(14\sim18)=1.25$) with sub-band SNR obtained from clean speech data.

TABLE 1

| | Method | | |
|---|---|---|---|
| Input SNR | Conventional over-subtraction | Present sub-band over-subtraction | Improvement of the present method |
| 15 dB | 2.39 | 3.33 | 39.3% |
| 10 dB | 3.86 | 4.76 | 23.3% |
| 5 dB | 5.64 | 6.64 | 17.5% |

From this comparison, it is known that at 15 dB input SNR, the present method has the potential of achieving 40% improvement over the conventional method. The potential improvements increase with input SNR.

Table 2 compares the averaged segmental SNR improvements of conventional over-subtraction method (with parameters of $\alpha_0=7.5$ and $SNR_1=20$) and those of the present method (with parameters of $\alpha_0(1\sim18)=2$, $\mu=0.25$, $SNR_1(1\sim9)=10$, $SNR_1(10\sim13)=15$, $SNR_1(14\sim16)=2$, and $SNR_1(17\sim18)=1.25$) with sub-band SNR obtained from the step S204 of sub-band SNR estimation.

TABLE 2

| | Method | | |
|---|---|---|---|
| Input SNR | Conventional over-subtraction | Present sub-band over-subtraction | Improvement of the present method |
| 15 dB | 2.39 | 2.80 | 17.0% |
| 10 dB | 3.86 | 4.09 | 6.0% |
| 5 dB | 5.64 | 5.96 | 5.7% |

From Table 2, it is known that at input SNR=15 dB, although the SNR value of sub-band is obtained by estimation, the present method still can achieve 17% improvement over the conventional method.

Although the present invention has been explained in relation to its preferred embodiment, it is to be understood that many other possible modifications and variations can be made without departing from the spirit and scope of the invention as hereinafter claimed.

What is claimed is:

1. A noise reduction method for dividing input noise speech into a plurality of continuous frames, determining a noisy speech spectrum for each frame, and partitioning a frequency band into multiple sub-bands to determine a clean speech spectrum from the noisy speech spectrum on each sub-band, the method comprising:

(A) estimating a noise spectrum $|W_r(k)|^2$ of an r-th frame at a k-th frequency component from the noisy speech $y_r(k)$ of the r-th frame by silence detection and noise spectrum estimation;

(B) estimating a signal-to-noise ratio (SNR) value $SNR_r(i)$ of an i-th sub-band for the r-th frame by applying a regression process to the SNR of the i-th sub-band for the (r−1)-th frame after noise reduction, the noisy speech spectrum, and the noise spectrum of the i-th sub-band for the r-th frame;

(C) determining an over-subtraction factor $\alpha_r(i)$ of sub-band i based on the estimated $SNR_r(i)$; and (D) determining a clean speech spectrum estimate by performing, on each sub-band, a spectral subtraction $|\hat{S}_r(i,k)|^2=|Y_r(i,k)|^2-\alpha_r(i)\cdot|W_r(i,k)|^2$, wherein $Y_r(i,k)|^2$ is the noisy speech spectrum of the r-th frame at the k-th frequency component of the i-th sub-band, $|W_r(i,k)|^2$ is the corresponding noise spectrum and $|\hat{S}_r(i,k)|^2$ is the clean speech spectrum at sub-band i for the r-th frame.

2. The noise reduction method as claimed in claim 1, wherein in step (C), the over-subtraction factor of the i-th sub-band for the r-th frame is:

$$\alpha_r(i) = \alpha_0(i) + SNR_r(i) \cdot \frac{1-\alpha_0(i)}{SNR_1(i)},$$

where $\alpha_0(i)$ is a pre-selected over-subtraction factor when the actual $SNR_r(i)=0$ at sub-band i, $SNR_1(i)$ represents a pre-selected SNR value when $\alpha_r(i)=1$.

3. The noise reduction method as claimed in claim 2, wherein, the over-subtraction factor $\alpha_r(i)$ of the sub-band is modified by the SNR value $SNR_r$ of the frame as:

$\alpha_r(i)=\alpha_{max}$ if $SNR_r<SNR_{min}$, where $SNR_{min}$ is a pre-selected minimum value of SNR.

4. The noise reduction method as claimed in claim 1 wherein $SNR_r(i)$ is obtained by a regression process:

$$SNR_r(i) = \mu \cdot SNR^o_{r-1}(i) + (1-\mu) \cdot 10 \cdot \log_{10}\left(\frac{\sum_{k \in sub-band\ i} |Y_r(i,k)|^2}{\sum_{k \in sub-band\ i} |W_r(i,k)|^2} - 1\right)$$

where μis a predetermined weight in a range of 0<μ<1, and $SNR_{r-1}{}^o(i)$ is the SNR of the sub-band i for the previous frame after noise reduction.

5. The noise reduction method as claimed in claim 4, wherein $SNR_{r-1}{}^o(i)$ is determined by:

$$SNR^o_{r-1}(i) = 10 \cdot \log_{10} \frac{\sum_{k \in sub-band\ i} |\hat{S}_r(i,k)|^2}{\sum_{k \in sub-band\ i} |W_r(i,k)|^2}.$$

* * * * *